United States Patent [19]

Purcell et al.

[11] 4,355,608

[45] Oct. 26, 1982

[54] SURGE BRAKE

[76] Inventors: Earl T. Purcell, 1329 Chestnut, Clarkston, Wash. 99403; Clifford A. Porter, 1305 Grelle, Lewiston, Id. 83501

[21] Appl. No.: 217,096

[22] Filed: Dec. 16, 1980

[51] Int. Cl.[3] ..... F02D 31/00

[52] U.S. Cl. ..... 123/364; 123/372

[58] Field of Search ..... 123/364, 365, 372, 379, 123/385

[56] References Cited

U.S. PATENT DOCUMENTS

| | | | |
|---|---|---|---|
| 2,845,915 | 8/1958 | Frick | 123/372 |
| 3,815,563 | 6/1974 | Stinsa | 123/372 |
| 4,176,642 | 12/1979 | Shipinski | 123/366 |
| 4,297,979 | 11/1981 | Kamleitner | 123/372 |

FOREIGN PATENT DOCUMENTS

| | | | |
|---|---|---|---|
| 629921 | 4/1936 | Fed. Rep. of Germany | 123/372 |
| 475477 | 11/1937 | United Kingdom | 123/370 |
| 548457 | 10/1942 | United Kingdom | 123/364 |
| 2028425 | 3/1980 | United Kingdom | 123/365 |

*Primary Examiner*—Ira S. Lazarus
*Assistant Examiner*—Magdalen Moy
*Attorney, Agent, or Firm*—Wells, St. John & Roberts

[57] ABSTRACT

A surge brake is described for application to a fuel pump for an internal combustion engine in which an elongated throttle rod is moved axially to control flow of fuel from the pump to the engine. The brake is mounted adjacent an end of the throttle rod and includes a plunger that is adapted to axially engage the throttle rod end. The plunger is spring loaded and positioned by adjustment provisions to produce a selected yieldable resistance to movement of the throttle or rod toward an open condition. Free axial motion of the throttle rod that produces "surging" of the engine is thereby effectively eliminated.

9 Claims, 2 Drawing Figures

SURGE BRAKE

BACKGROUND OF THE INVENTION

The present invention is related to apparatus for controlling undesired throttle rod movement in fuel injection pumps that cause engine "surging" or a constant rythmic increase and decrease in engine rpm when the throttle is held steady.

Surging is a condition that is common in diesel engines. It occurs within the fuel pump and throttle control components. Surging is annoying to the driver and can be hazardous, for example, on icy roads. Surging also causes waste of fuel and engine wear, due to unnecessary repeated "surges" of fuel beyond the amount demanded by the throttle setting.

Surging is typically caused by wear in the throttle-governor control attached to the fuel pump. Linkages and springs wear and eventually allow a certain amount of free movement of the throttle rod. The throttle rod can therefore move freely toward an open condition until the governor components react and return the throttle rod to the selected throttle setting. Attempts made to correct the problem are costly and seldom effective due to the complexity of the throttle control mechanisms.

Correction of the problem follows a "teardown" of the throttle control assembly to allow access to the worn parts. New parts are installed and the unit must be reassembled for testing. If the wrong parts are used, the unit must again be disassembled and another attempt made at correcting the problem. Even when a satisfactory adjustment can be made, the whole process must be repeated as soon as the components wear more.

The obvious alternative solution to the surging problem is complete replacement of the throttle control mechanisms. It is not infrequent, however, that new controls have a "built-in" surging problem. Furthermore, replacement is usually cost prohibitive.

It therefore remains desirable to obtain a simplified device that will effectively eliminate surging without requiring dismantling of the throttle control unit or its replacement. It is desirable to obtain such a device that can be quickly and easily adjusted to compensate for continued wear within the throttle controls.

The present invention represents a complete solution to "surging" problems without requiring replacement or disassembly of the throttle controls. It also includes features that will allow adjustment to compensate for continued wear within the control assembly. The present device operates as a "brake", stopping the surging motion of the throttle rod while yieldably allowing controlled opening and closing of the throttle. It is mounted to the fuel pump axially adjacent a free end of the throttle rod, with a plunger head situated in the path thereof. The plunger head is spring loaded to engage the throttle and to offer selected yieldable resistance to movement of the throttle rod toward the open position. The resistance offered by the plunger thus eliminates the free surging movement of the throttle rod. Adjustment features allow the plunger to be set at a preselected position in relation to the throttle rod so it will be engaged only at the throttle range where surging occurs. These adjustments can be periodically reset to change the effective position of the plunger to compensate for subsequent wear in the throttle components.

DETAILED DESCRIPTION OF A PREFERRED EMBODIMENT

Figure 1:
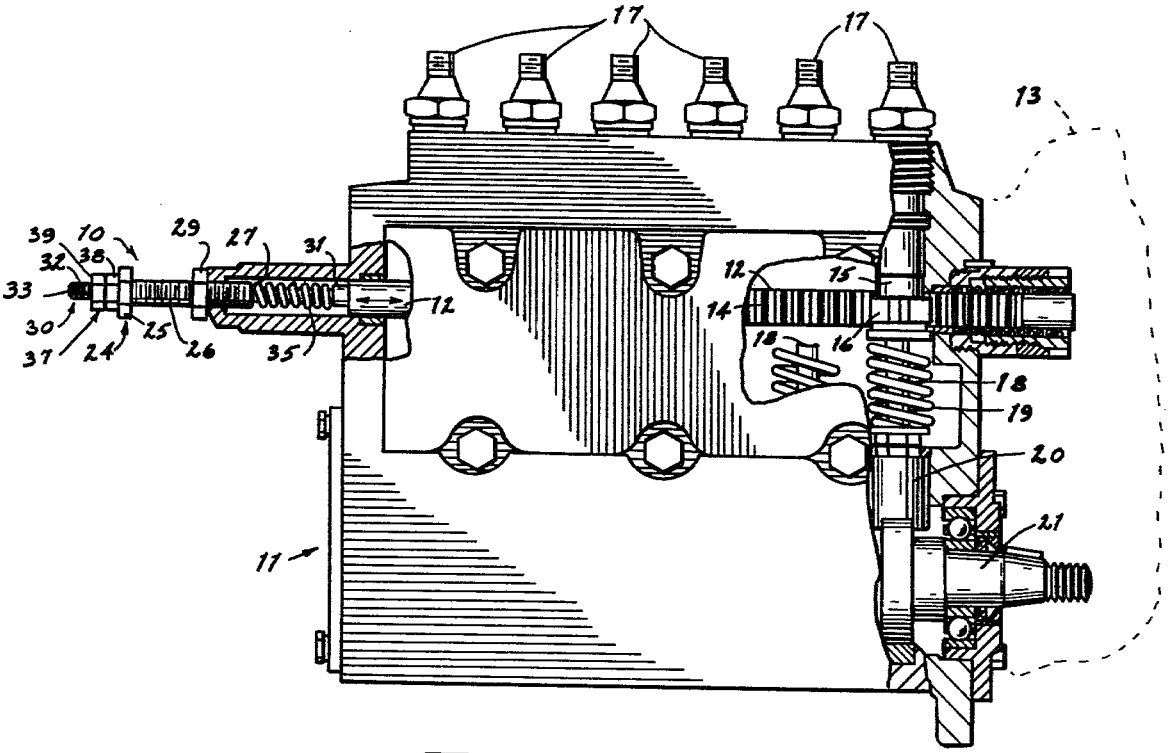
FIG. 1 is a diagrammatic view of a standard fuel pump showing the present surge brake mounted thereto.

A surge brake mechanism embodying a preferred form of the present invention is shown generally in the drawings by the reference numeral 10. The present surge brake is intended for use in fuel injection pumps 11 of the variety having an elongated throttle rod 12 that is operated to move axially by a throttle-governor mechanism shown in dotted lines at 13. The throttle rod typically includes a series of racks 14 along its length that mesh with an equal number of gear segments on rotatable control sleeves 16. The sleeves 16 encircle fuel cylinder barrels 15 and are rotated in response to axial motion of the throttle rod. Apertures (not shown) in the control sleeves are enlarged or reduced as the sleeves rotate, thereby permitting a variable flow of fuel through the fuel discharge fittings shown at 17.

The injector pump 11 produces forced flow of fuel in measured amounts to individual cylinders of the associated engine (not shown). This is accomplished by reciprocating pistons within the cylinder barrels 15 (the pistons are driven by piston rods 18 having tappets 20 at lower ends thereof). Retainer springs 19 hold the tappets against the lobes of a cam shaft 21. Rotation of the cam shaft will cause reciprocating motion of the pistons within the cylinder sleeves. This motion is timed in relation to operation of the associated engine so fuel will be delivered "in time" with the engine operation.

The above brief description of the fuel injection pump 11 has been given to briefly familiarize the reader with the type of pump best suited for use with the present invention. Other pumps presently known and available that make use of an axially movable throttle control rod 12 may also be used with the present surge brake 10.

Figure 2:
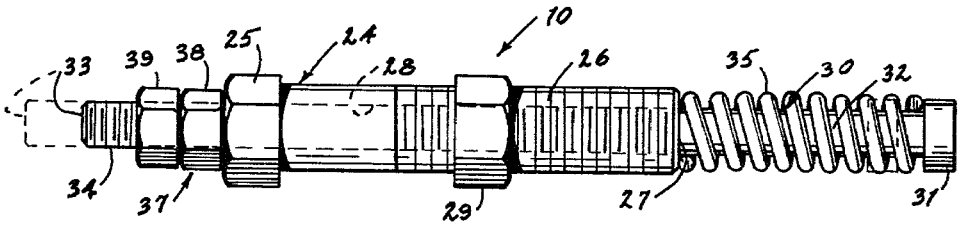
FIG. 2 is a detailed view of the present surge brake mechanism.

The surge brake 10 is shown mounted to a pump 11 in FIG. 1 and in enlarged detail in FIG. 2. The brake 10 basically includes a threaded carrier bolt 24. The bolt has a headed end 25 at one end of a threaded shank 26. An abutment surface 27 is provided at an opposite end of the bolt.

An open bore 28 extends through the carrier bolt 24 from the headed end 25 to the abutment surface 27. It is preferred that the bore 28 be coaxial with the bolt axis. When the bolt is installed on the pump 11, the bore 28 will openly communicate with the pump interior and will be substantially coaxial with the throttle rod 12.

The threaded shank of the carrier bolt 24 receives a depth adjustment means in the form of a nut 29. The nut is selectively movable along the length of the shank to come into engagement with the injection pump housing and thereby position the abutment surface at a selected axial position in relation to the throttle rod. This nut will also serve to lock the bolt shank to the pump housing to secure the abutment surface in the selected position.

An elongated plunger 30 is slidably received within the bore 28 of the carrier bolt. The plunger includes an enlarged plunger head 31 at one end of an elongated shaft 32. A remaining end 33 of the shaft extends axially outward of the headed bolt end 25. The plunger protrudes axially beyond the abutment surface 27. Threads 34 are provided at the shaft end 33.

A biasing means 35, preferably in the form of a coiled compression spring, is positioned between the plunger 30 and carrier bolt 24 to yieldably resist motion of the plunger head toward the abutment surface. The biasing means 35 will therefore yieldably urge the plunger head against the throttle rod when it is moved into engagement therewith and presses axially in the direction of the abutment surface. The biasing means 35 is preferably provided in the form of a compression spring having one end in engagement with the abutment surface 27 and the remaining end in engagement with the enlarged plunger head 31. FIGS. 1 and 2 show such a compression spring mounted coaxially over the plunger shaft 32.

An adjustment means is provided at 37 operably connecting the plunger and carrier bolt. The adjustment means 37 is useful to selectively vary the resistance of the biasing means to axial motion of the plunger head 31 toward the abutment surface. The spring resistance, in other words, can be selectively adjusted by "preloading" the spring to a selected compression to offer a selected resistance to motion of the throttle rod toward the abutment.

The adjustment means 37 is preferably comprised of a nut 38 threadably engaged with a threaded portion 34 of the plunger shaft 32. It is also preferred that a locking nut 39 be provided along with the nut 38 to secure the nut 38 in its selected position. In use, the nut 38 will come into abutment with the headed end 25 of the carrier bolt to limit axial movement of the plunger head away from the abutment surface. The limitation defined by the nut 38 can be selectively adjusted simply by turning the nut on the threaded portion of the plunger shaft. In doing so, the plunger head is drawn toward or allowed to move away from the carrier bolt abutment surface 27. It is noted that this also affects the "stroke" or distance that the plunger head is able to travel toward the abutment surface. This is a consideration that must be taken into account when mounting the present brake assembly to a pump 11.

Installation of the present surge brake varies with the nature of the pump 11. Many pumps of the axially movable throttle rod type include a plug within the housing adjacent the free end of the throttle rod 12. If not, a hole can be drilled and tapped that is in substantially axial alignment with the throttle rod and includes free access to the free rod end. Once the threaded hole is exposed, initial steps can be taken prior to installation.

It is desirable to determine the throttle setting at which surging occurs. It is noted that the surge can occur nearly anywhere within the throttle range. Therefore, the engine is started and the throttle is moved to the position where surging begins. The throttle is then held in that position and a measurement is taken between the free throttle rod end and the surface on the housing which will abut the nut 29. This determines the overall distance dimension between the nut 29 and the end of the plunger head 31. The brake mechanism can therefore be set by this measurement.

Attention should also be directed to the position of the free throttle rod end at full throttle. This measurement can be made without the engine running. The accelerator is simply depressed to the full throttle position and a second measurement is taken between the free throttle rod end and the surface of the pump housing that will abut the nut 29. This distance can be equated with the effective distance between the nut 29 and the plunger head 31 when the spring is fully compressed. The two above adjustments can be made by altering position of the depth adjustment nut 29 along the bolt shank 26 and by turning the adjustment nut 38 and locking nut 39 along the length of the plunger shaft 32. The adjustments should be made so that when the unit is mounted to the pump, the plunger head 31 will be situated at the exact axial position in the path of the throttle rod where surging occurs.

The adjusted unit is installed simply by inserting the plunger head 31 and spring through the threaded opening formed through the fuel pump housing and by threadably engaging the carrier bolt shank 26 with the threaded hole. The headed end of the carrier bolt is used in turning the shank until the nut 29 comes into abutment with the pump housing. At this point the nut 29 can be turned slightly against the housing to lock the carrier bolt in the desired position. If previous adjustments have been made correctly, the plunger head 31 will be automatically positioned to engage the throttle rod at the throttle position where surging previously occurred.

The throttle rod can then be operated in the usual manner to rotate the control sleeves 16 and thereby vary the fuel output of the pump. At the throttle range where surging occurs, however, the throttle rod end will come into engagement with the plunger head. The resistance offered through the biasing means takes up the free play of the mechanisms connected to the throttle rod and continues to yieldably resist such free motion through the remainder upper portion of the rpm range. The spring automatically returns the plunger head to the initial preselected position as the throttle rod is allowed to move back toward its original idle position.

It is understood that additional wear will eventually occur within the throttle control mechanisms of the associated pump. Therefore, periodic adjustments can be made to situate the plunger head at various positions in the axial path of the throttle rod. The stroke of the plunger can also be varied by moving the nut 38 along the length of the bolt shank. Adjustments can also be made to vary the spring resistance offered by the biasing means. It can therefore be understood that continued adjustment can be made periodically to accommodate both for mechanical wear in the throttle and governor control components as well as for wear of the present biasing means. Furthermore, removal and replacement of the present brake assembly is accomplished with simple tools and without requiring dismantling of the pump.

The present invention operates by way of back pressure against the throttle rod, to prevent axial "surging" of the rod toward the abutment surface 27 to effectively and completely eliminate surging wherever it occurs throughout the operable throttle range.

The above description and attached drrawings are given by way of example to set forth the preferred form of the invention.

Having thus described our invention, what we claim is:

1. A surge brake for conditioning axial movement of a throttle rod in a fuel injection pump, comprising:

a carrier bolt having an axially threaded shank adapted to be fitted to the pump, said bolt including an abutment surface at one end of the shank adapted to be located at a selected position axially adjacent to the throttle;

said carrier bolt including an open axial bore;

an elongated plunger received within the axial bore of the carrier bolt for axial movement therein, said plunger having a plunger head at one end and a remaining end, the plunger head extending axially beyond the carrier bolt abutment surface and adapted to axially engage the throttle rod;

biasing means operably engaged between the plunger and carrier bolt for yieldably resisting axial movement of the plunger head toward the carrier bolt abutment surface; and axial adjustment means on the plunger for selectively limiting the extension of said plunger head beyond said carrier bolt abutment surface and adapted to vary resistance of the biasing means to axial motion of the plunger head toward the carrier bolt abutment surface independently of the axial position of the carrier bolt in relation to the throttle rod.

2. The surge brake as claimed by claim 1 further comprising depth adjustment means on the carrier bolt selectively movable along the shank and adapted to axially position the abutment surface in a selected position in relation to the throttle rod.

3. The surge brake as claimed by claim 1 wherein the plunger is threaded at its remaining end and wherein the adjustment means is comprised of a threaded nut on the threaded plunger end for selectively limiting axial travel of the plunger head away from the abutment surface.

4. The surge brake as claimed by claim 1 wherein the biasing means is comprised of a compression spring mounted over the plunger and engaged between the plunger head and abutment surface.

5. The surge brake as claimed by claim 1 further comprising a nut on the threaded shank of the carrier bolt, adapted to engage the fuel pump to position the abutment surface a selected axial distance from the throttle rod.

6. A surge brake for conditioning axial movement of a throttle rod in a fuel injection pump, comprising:

a threaded carrier bolt having a threaded shank adapted to be fitted to the pump in axial alignment with the throttle rod and adjacent an end thereof;

said bolt having a headed end and an abutment surface at a remaining end;

said bolt also including an open bore extending axially from the abutment surface to the headed end;

an elongated plunger extending through the bolt within said bore, having an enlarged plunger head at one end spaced axially beyond the abutment surface, and a remaining end projecting axially outward of the headed bolt end;

wherein the plunger is threaded adjacent its remaining end;

an adjusting nut threadably engaged on the plunger for abutment with the headed bolt end;

a compression spring mounted on the plunger between the plunger head and bolt abutment surface for urging the plunger head axially outward of the abutment surface to a limit defined by the adjusting nut;

wherein the adjusting nut and headed bolt end are adapted to position the plunger head in a selected axial position in relation to the throttle rod to engage the throttle rod as it is moved axially to the selected position, and to provide yieldable resistance against further movement of the throttle rod in the same direction.

7. The surge brake as claimed by claim 6 further comprising:

a nut threadably engaging the threaded shank of the bolt adapted to lock the bolt on the injection pump with the abutment surface of the bolt projecting a prescribed distance into the pump.

8. The surge brake as claimed by claim 6 further comprising a locking nut on the threaded section of the plunger for locking the adjusting nut in a selected position on the plunger.

9. The surge brake as claimed by claim 8 further comprising:

a nut threadably engaging the threaded shank of the bolt adapted to lock the bolt on the injection pump with the abutment surface of the bolt projecting a prescribed distance into the pump.

* * * * *